US006732691B1

(12) United States Patent
Lee et al.

(10) Patent No.: US 6,732,691 B1
(45) Date of Patent: May 11, 2004

(54) ENGINE PHASER CONTROL SYSTEM USING PHASER INSTABILITY MEASUREMENT

(75) Inventors: Jongmin Lee, Pittsford, NY (US); Timothy M. Nieves, Geneseo, NY (US); Jeffrey M. Pfeiffer, Walled Lake, MI (US); Amanpal S. Grewal, Novi, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/455,677

(22) Filed: Jun. 5, 2003

(51) Int. Cl.[7] ..... F01L 1/34
(52) U.S. Cl. ..... 123/90.17; 123/90.15
(58) Field of Search ..... 123/90.17, 90.15, 123/90.31

(56) References Cited

U.S. PATENT DOCUMENTS 6,474,278 B1 * 11/2002 Davis et al. ..... 123/90.15
6,609,498 B2 * 8/2003 Mathews et al. ..... 123/406.62

* cited by examiner

*Primary Examiner*—Thomas Denion
*Assistant Examiner*—Zelalem Eshete
(74) *Attorney, Agent, or Firm*—Patrick M. Griffin

(57) ABSTRACT

A camshaft phaser control system including a camshaft target wheel, the target wheel having first and second teeth for measuring camshaft oscillatory instability. The trailing edge of the first tooth coincides with the negative camshaft oscillation peak, and the trailing edge of the second tooth coincides with the positive camshaft oscillation peak. During each camshaft rotation, each tooth initiates an input signal to generate first and second input signals in known fashion. During crankshaft rotation, a third input signal is generated corresponding to the rotational position of the crankshaft. From these signals, operational camshaft oscillatory instability is computed by an engine monitoring system (EMS). Any deviation from the operational instability while the engine is operating is a direct measurement of oscillatory instability of the camshaft about its nominal holding position. A change in oscillatory instability is inferred as system malfunction, permitting defensive action to be taken by the EMS.

9 Claims, 2 Drawing Sheets

ENGINE PHASER CONTROL SYSTEM USING PHASER INSTABILITY MEASUREMENT

TECHNICAL FIELD

The present invention relates to camshaft phasers for internal combustion engines; more particularly, to schemes for controlling the action of such camshaft phasers; and most particularly, to a method and apparatus for controlling such action, including a novel target wheel for measuring the phaser instability within a camshaft revolution, and a means for compensating for shifts in measured instability.

BACKGROUND OF THE INVENTION

Camshaft phasers for varying the valve timing of internal combustion engines are well known. A phaser typically comprises a rotor element attached to the end of a camshaft and variably displaceable rotationally within a stator element driven by the engine crankshaft. Phasers typically are actuated by pressurized oil derived from the engine's main oil supply and selectively directed to chambers within the phaser to alter the phase relationship between the rotor and stator, and hence between the camshaft and crankshaft.

A torque-imposed instability is known in the art that can cause the phase relationship to vary from nominal during a 360° rotational cycle of the camshaft. In opening an engine valve, the valve follower leaves the base circle portion of the camshaft lobe and begins to climb the rising edge of the eccentric portion, imposing a resistive (negative) torque on the camshaft. At some further position of camshaft rotation, the resistive torque reaches a maximum negative torque, then returns to zero, and then becomes an assistive (positive) torque as the follower descends the falling edge of the eccentric portion of the lobe, as the valve closes. This negative-positive fluctuation repeats itself during subsequent rotational cycles of the camshaft lobe. Because of mechanical and hydraulic lash in the system, and as a result of the fluctuating torque, the actual rotor position with respect to the stator may be significantly different from intended during valve opening and closing. The difference between the maximum negative and positive angular departures from nominal is known in the art as "phaser instability". A typical cam phaser in good working order exhibits a characteristic and repeatable level of operational phaser instability due to the inherent mechanical and hydraulic lash in the system. However, an undesirable shift in the predictable level of phaser instability can result in sub-optimal valve phasing relative to crankshaft rotation.

What is needed is means for measuring the level of instability continually during engine operation, detecting when the level of instability changes, and causing the cam phaser and engine to take predetermined action when measured instability exceeds a predetermined threshold level.

It is a principal object of the present invention to detect when the level of instability in a camshaft phaser changes.

It is a further object of the invention to alarm such changes and to cause the phaser to take predetermined action to minimize potential problems such as engine malfunction and emissions increase.

SUMMARY OF THE INVENTION

Briefly described, a camshaft phaser control system in accordance with the invention includes a target wheel mounted on a phaser rotor which in turn is rotatable with the camshaft. Alternately, the target wheel may be machined in an end of the camshaft or otherwise fixed to the camshaft in known fashion. (For purposes of illustration, the target wheel described herein is mounted on the phaser rotor). As a reference point, the phaser control system also includes a means for detecting the rotational position of the crankshaft.

The target wheel is provided with first and second signal-initiating means, preferably in the form of trailing or falling edges of a first and second tooth on the target wheel, for measuring camshaft oscillatory instability. A first tooth is angularly placed with respect to one of the cam lobes such that the falling edge of the first tooth coincides with the peak excursion of the negative camshaft oscillation. The second tooth is angularly placed with respect to the same cam lobe such that the falling edge of the second tooth coincides with the peak excursion of the positive camshaft oscillation. Such peaks are readily determined via a torsion meter applied to a test engine, in known fashion.

The target wheel is mounted on the phaser rotor or on the camshaft such that, during camshaft rotation, the trailing edge of the first and second tooth initiates a signal to generate first and second signals in known fashion. In addition, equally spaced teeth are placed radially about the axis of rotation of the crankshaft to detect the rotational position of the crankshaft to serve as a reference point for the phaser control system.

The signals are transmitted to an electronic monitoring system which, in turn, by algorithm, measures phaser instability. This measurement is taken, for example, every camshaft rotation so that if a shift in phaser instability occurs, which can signify degraded phaser performance, the electronic monitoring system can take defensive actions.

Locating the teeth at the specific positions with respect to the cam lobe provides three important benefits. First, the system thus measures the maximum oscillatory instability in phaser performance, and therefore any increase in instability amplitude may be inferred as system malfunction. Second, such placement also maximizes the sensitivity of the system to such malfunction. Third, such placement makes the system least sensitive to changes in angular location of the peaks, which may shift as much as ten crank angle degrees with changes in engine speed.

The EMS is programmed in known fashion to change the duty cycle of the phaser, to limit phaser operation, or even to disable phasing, based on the magnitude of the instability. The system continues to monitor the level of instability. Should instability fall below the threshold limit, normal phasing operation is resumed.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
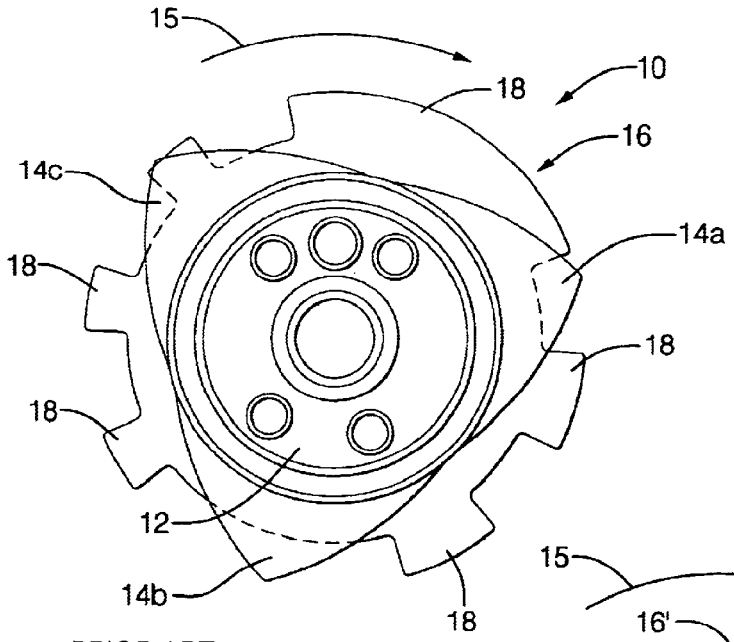
PRIOR ART FIG. 1
FIG. 1 is an end view of a camshaft having a prior art target wheel for a camshaft phaser (phaser omitted for clarity)

Referring to FIG. 1, a camshaft assembly 10 for an internal combustion engine (not shown) includes a camshaft 12 supporting three substantially identical cam lobes 14*a*, 14*b*, 14*c* trigonally disposed from each other along camshaft 12. Camshaft assembly 10 is exemplarily an intake valve camshaft for a three-cylinder bank of a V-6 engine. A prior art target wheel 16 mounted on camshaft 12 is provided with a plurality of angularly-discrete teeth 18 for intermittently intercepting a source signal (not shown in FIG. 1) impingent upon a sensor (also not shown in FIG. 1), such as for example, a Hall effect sensor, to produce a square wave (interrupted) signal indicative of known performance parameters of camshaft assembly 10. Typically, camshaft assembly 10 is connected to a camshaft phaser (not shown in FIG. 1), and the performance parameters relate to the degree of valve timing advance or retard afforded by such a phaser during rotation 15 thereof during engine operation. The signal generating and sensing system may be optical, magnetoinductive, or the like, as is known in the prior art.

Figure 2:
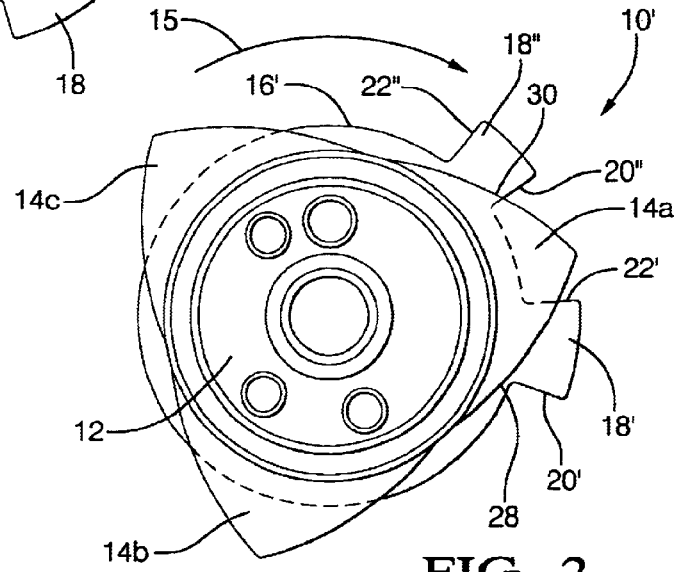
FIG. 2 is an end view of the camshaft shown in FIG. 1 equipped with an improved target wheel in accordance with the invention.

Referring to FIG. 2, an improved camshaft assembly 10' in accordance with the invention includes camshaft 12 and cam lobes 14*a*,14*b*,14*c* as in the prior art camshaft assembly 10 and is adapted to substitute for assembly 10 in a camshaft phaser and associated engine 13. The improvement is defined by an improved target wheel 16' having at least two angularly-discrete teeth 18', 18" angularly positioned relative to cam lobe 14*a* as described below. Of course, as the cam lobes are identical, they are indistinguishable, and either of the other two might equally be selected. Because the method of the invention requires rotational analysis of the camshaft only once per revolution, only one of the cam lobes need be involved. Each tooth 18', 18" has a leading edge 20', 20" and a trailing edge 22', 22", defined by the direction 15 of camshaft rotation.

Figure 3:
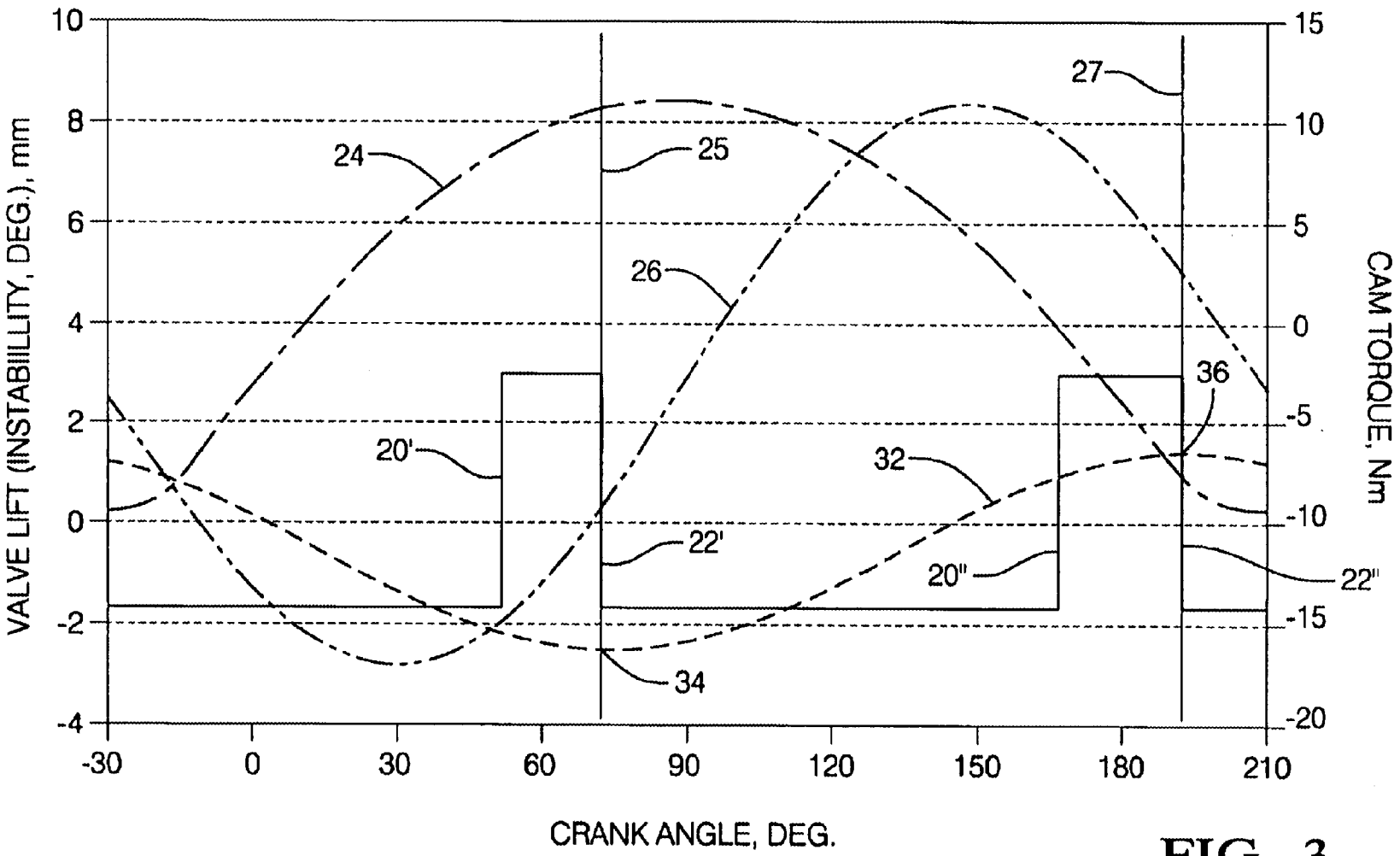
FIG. 3 is a graphical representation of the variation in valve opening distance, variation in camshaft torque, and variation in camshaft instability as a function of engine crankshaft angle, having the target wheel signal-initiating function superimposed thereupon.

Referring to FIG. 3, several activities are shown simultaneously as a function of the rotation of an engine crankshaft coupled to an improved engine camshaft assembly 10' via a camshaft phaser. In a typical four-stroke engine as exemplarily described herein, the crankshaft rotates twice for each rotation of the camshaft; thus, each lobe 14 in the example 10' shown herein has an actuation domain of 240 crank angle degrees.

Curve 24 shows the lift in millimeters of a typical engine valve through opening and closing by cam lobe 14*a*. Curve 26 shows the torque in Newtonmeters imposed on camshaft assembly 10' by actuation of the valve cam follower for lobe 14*a*. Note that the initial imposed torque value is negative (counter to camshaft rotation 15) as the follower begins to ascend the opening flank (rising edge) 28 of lobe 14*a* (FIG. 2), reaching a minimum of approximately−16 Nm when the valve is about half-open; then becomes increasingly positive (in the direction 15 of camshaft rotation), passing through 0 just ahead of the peak opening of the valve; reaches a maximum value in excess of +11 Nm when the follower is descending the closing flank (falling edge) 30 of the lobe and the valve is about half-closed; and remains positive through the remainder of the valve cycle until the follower is once again on the base circle portion of the cam lobe.

The alternating negative and positive torque exerted on the camshaft causes a predictable oscillatory instability in the instantaneous camshaft angular position during valve actuation by each lobe 14*a*, 14*b*, 14*c*, as shown in curve 32 in FIG. 3 wherein instability is expressed in angular deviation from nominal (0) during actuation by a single lobe 14*a*. In the example shown, the operational instability curve 32 nearly mirrors the valve opening curve 24, reaching a minimum of about −2.5 degrees near the valve opening peak and a maximum of about +1.5 degrees when the valve is nearly closed again. The effect of such torque fluctuation on the camshaft is that the valve opening is slightly delayed and the valve closing is slightly accelerated from nominal. Because of mechanical and hydraulic lash in the valve actuation system, including the cam phaser, a characteristic phaser hold instability is to be expected and can be accommodated at a fixed and steady-state net (peak-to-peak) amplitude.

Figure 4:
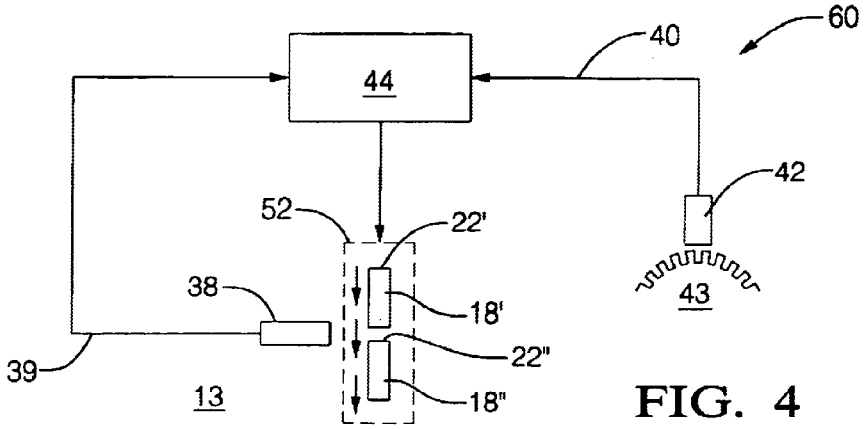
FIG. 4 is a schematic drawing of a camshaft phaser control system in accordance with the invention.

Referring to FIGS. 2 through 4, first tooth 18' of the invention is angularly placed with respect to rising edge 28 of cam lobe 14*a* such that trailing edge 22' coincides with the peak point of the negative camshaft oscillation peak excursion 34, graphically shown as point 25 in FIG. 4. Second tooth 18" is angularly placed with respect to falling edge 30 of the same cam lobe such that trailing edge 22" coincides with the peak point of the positive camshaft oscillation excursion 36, graphically shown as point 27 in FIG. 4. As shown in FIG. 2 and schematically in FIG. 4, in an engine phaser control system 60 in accordance with the invention, teeth 18', 18", are positioned with respect to lobe 14*a* such that during a full rotation of target wheel 16', the trailing edge 22', 22" of each tooth induces a signal received by a receiver 38, as for example, a Hall effect sensor. The receiver 38, in turn, transmits a signal 39 to an electronic monitoring system (EMS) 44, in known fashion. The EMS also receives a signal 40 from crankshaft position sensor 42 which determines the precise angular position of the crankshaft 43 in its rotation.

With the camshaft phaser system in good working order, a baseline level of phaser instability is measured by EMS 44 by algorithm, based on received signals 39 and 40. This measurement is taken every camshaft rotation. Thus, any changes to the baseline level of phaser instability, as measured by EMS 44, is a direct measurement of an increase in holding position instability of the phaser. Prior art phaser monitoring techniques are not able to make such an important and direct measurement.

In accordance with the present invention, instability amplitude can be monitored continuously as an operating characteristic of a cam phaser system. Increases in the amplitude of instability during engine operation can signify degraded performance of the phaser, as may be caused by drop in phaser actuating oil pressure, oil filter clogging, oil aeration, etc. Such increases can be signals for an electronic monitoring system to take defensive action 52, such as to disable or limit phasing, or to change the operational duty cycle of the phaser when a threshold amplitude of instability is deviated from, until such time as the amplitude returns to an acceptable value.

A target wheel in accordance with the invention has been described as having first and second radial teeth extending therefrom. All other signal initiating means as may occur to one skilled in the art, though not illustrated or otherwise described herein, are fully comprehended within the scope of the invention. For example, a solid wheel may have one or more apertures therethrough at appropriate radial locations, or a wheel may comprise a single tooth having leading and trailing edges coincident with the appropriate rising and falling lobe locations. Further, a target wheel in accordance with the invention may include additional teeth or other initiating chopping means for other monitoring purposes.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for measuring instability of holding position of a camshaft phaser relative to a position of a crankshaft during operation thereof by an associated internal combustion engine, comprising:

a) engine monitoring means including programmable means for receiving signals, and analyzing said signals;

b) a camshaft including at least one eccentric lobe extending over an angular portion of said camshaft, said lobe having a rising edge for opening an associated valve of said engine and a falling edge for closing said associated valve;

c) a target wheel rotatable by said camshaft;

d) first signal-initiating means on said target wheel angularly positioned with respect to said rising portion of said lobe such that a first input signal is initiated by said first means at a first time;

e) second signal-initiating means on said target wheel angularly positioned with respect to said falling portion of said lobe such that a second input signal is initiated by said second means at a second time, said second signal-initiated means being angularly offset from said first signal-initiating means;

f) a third initiating means such that a third input signal is initiated corresponding to a rotational position of said crankshaft, said engine monitoring means being programmed to receive said first, second and third input signals, to compute therefrom a measured amplitude of said holding position instability.

2. A system in accordance with claim 1 wherein said first signal-initiating means includes a first radial tooth disposed on said target wheel and having a first radial edge.

3. A system in accordance with claim 1 wherein said second signal-initiating means includes a second radial tooth disposed on said target wheel and having a second radial edge.

4. A system in accordance with claim 1 wherein said third signal-initiating means includes radial teeth disposed on said crankshaft.

5. A system in accordance with claim 1 wherein said first and second signal-initiating means are angularly positioned at first and second positions, respectively, with respect to said rising and falling portions of said lobe such that said first position coincides with maximum negative angular departure of said phaser holding position from nominal and said second position coincides with a maximum positive angular departure from nominal of said phaser holding position.

6. A system in accordance with claim 1 wherein said instability has a characteristic amplitude during normal operation of said engine and phaser.

7. A system in accordance with claim 5 wherein said engine monitoring means is programmed to output a defensive action when said measured amplitude of said holding position instability deviates from said characteristic amplitude.

8. A method for measuring operational angular amplitude of holding instability of a camshaft phaser during engine operation, the camshaft having at least one eccentric lobe having a rising edge and a falling edge, the method comprising the steps of:

a) providing a target wheel rotatable with said camshaft and having first and second signal-initiating means;

b) providing a crankshaft having a third signal-initiating means;

c) angularly locating said first signal-initiating means at a point along said rising lobe edge;

d) angularly locating said second signal-initiating means at a point along said falling lobe edge;

e) initiating a first, second and third signal from said first, second, and third signal initiating means;

f) receiving said first, second and third signals to provide said operational angular amplitude of holding instability of said phaser.

9. A method for controlling actuation of a camshaft phaser for an internal combustion engine by measuring operational angular amplitude of holding instability of the phaser during engine operation, the camshaft having at least one eccentric lobe having a rising edge and a falling edge, the method comprising the steps of:

a) providing a target wheel rotatable with said camshaft and having first and second signal-initiating means;

b) providing a crankshaft having a third signal-initiating means;

c) angularly locating said first signal-initiating means at a point along said rising lobe edge;

d) angularly locating said second signal-initiating means at a point along said falling lobe edge;

e) initiating a first, second and third signal from said first, second and third signal initiating means, f) receiving said first, second and third signals to provide said operational angular amplitude of holding instability of said phaser;

g) providing a threshold amplitude value of holding instability of said phaser;

h) comparing said operational angular apparent amplitude to said threshold amplitude value; and i) effecting a change in said camshaft phaser when said operational angular apparent amplitude deviates from said threshold amplitude value.

* * * * *